US008147932B2

(12) United States Patent
Despland et al.

(10) Patent No.: US 8,147,932 B2
(45) Date of Patent: Apr. 3, 2012

(54) BLACK-TO-COLOR SHIFTING SECURITY ELEMENT

(75) Inventors: Claude-Alain Despland, Prilly (CH); Albert Stichelberger, Renens (CH); Edgar Müller, Fribourg (CH); Pierre Degott, Crissier (CH)

(73) Assignee: Sicpa Holding SA, Prilly (CH)

( * ) Notice: Subject to any disclaimer, the term of this patent is extended or adjusted under 35 U.S.C. 154(b) by 975 days.

(21) Appl. No.: 11/912,348

(22) PCT Filed: Apr. 5, 2006

(86) PCT No.: PCT/EP2006/061322

§ 371 (c)(1),
(2), (4) Date: Nov. 1, 2007

(87) PCT Pub. No.: WO2006/117271

PCT Pub. Date: Nov. 9, 2006

(65) Prior Publication Data

US 2009/0278345 A1 Nov. 12, 2009

(30) Foreign Application Priority Data

May 4, 2005 (EP) ..... 05103729

(51) Int. Cl.
*B44F 1/10* (2006.01)
*B41M 5/00* (2006.01)
*G03G 7/00* (2006.01)

(52) U.S. Cl. ..... 428/29; 428/195.1; 428/916; 283/91

(58) Field of Classification Search ..... 428/195, 428/200, 199, 201–202, 206–207, 915–916, 428/345–346, 402, 41.8, 42.1, 347, 352, 428/29; 359/577, 580, 584, 585–589, 350–360; 283/91, 85; 106/400–401, 415, 436, 450, 106/453, 903; 430/10, 17–18, 24, 292, 334, 430/336, 339, 321, 333; 235/487, 491–494, 235/380

See application file for complete search history.

(56) References Cited

U.S. PATENT DOCUMENTS

| | | | | |
|---|---|---|---|---|
| 4,424,010 | A | 1/1984 | McCullough | |
| 4,434,010 | A | 2/1984 | Ash | |
| 4,705,356 | A * | 11/1987 | Berning et al. | 359/590 |
| 4,838,648 | A | 6/1989 | Philips et al. | |
| 4,879,140 | A | 11/1989 | Gray et al. | |
| 5,059,245 | A | 10/1991 | Phillips et al. | |
| 5,084,351 | A | 1/1992 | Philips et al. | |
| 5,171,363 | A | 12/1992 | Philips et al. | |
| 5,214,530 | A * | 5/1993 | Coombs et al. | 359/359 |

(Continued)

FOREIGN PATENT DOCUMENTS

| | | |
|---|---|---|
| DE | 19502413 | 8/1996 |
| DE | 19525503 | 1/1997 |
| EP | 227423 | 7/1987 |
| EP | 338428 | 10/1989 |
| WO | 01/03945 | 1/2001 |

*Primary Examiner* — Mark Ruthkosky
*Assistant Examiner* — Laura C Dettinger
(74) *Attorney, Agent, or Firm* — Greenblum & Bernstein, PLC

(57) ABSTRACT

The invention discloses a security element for a banknote, a document of value, right or identity, a ticket, a label, a branded good identifier, or a tax banderole. The element comprises a combination of a coating containing at least one optically variable pigment having a substantial viewing-angle dependent color variation, with at least one selective spectral absorbing material, which blocks out visible spectral components reflected by the optically variable pigment at orthogonal incidence. The security element appears black when viewed at orthogonal angle, and colored when viewed at grazing angle.

12 Claims, 5 Drawing Sheets

Figure 1A:
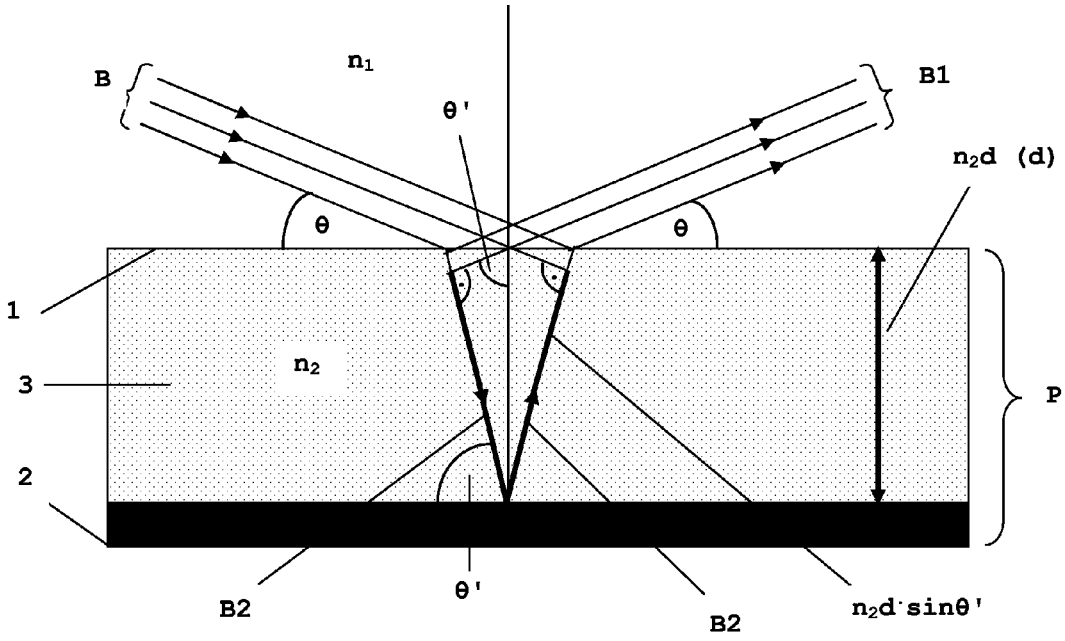

U.S. PATENT DOCUMENTS 5,278,590 A 1/1994 Philips et al.
5,279,657 A 1/1994 Philips et al.
5,281,480 A 1/1994 Philips et al.
5,383,995 A 1/1995 Philips et al.
5,569,535 A 10/1996 Philips et al.
5,571,624 A 11/1996 Philips et al.
5,653,792 A 8/1997 Philips et al.
5,766,738 A * 6/1998 Phillips et al. ..... 428/200
2005/0067497 A1 * 3/2005 Jones et al. ..... 235/492

* cited by examiner

Fig. 2a (Orthogonal view)
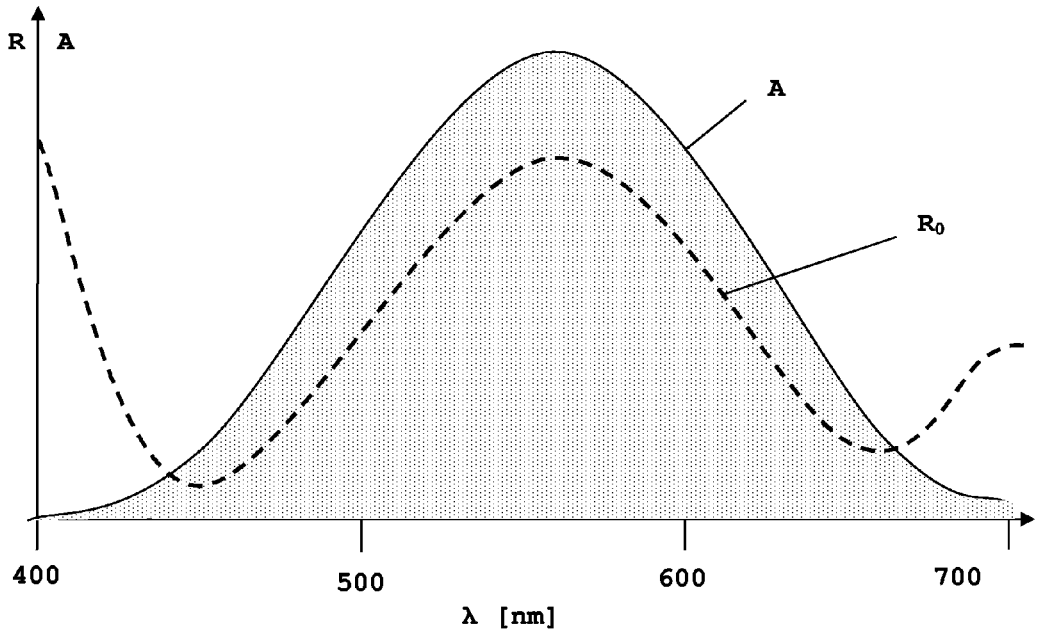
Fig. 2b (Grazing view)
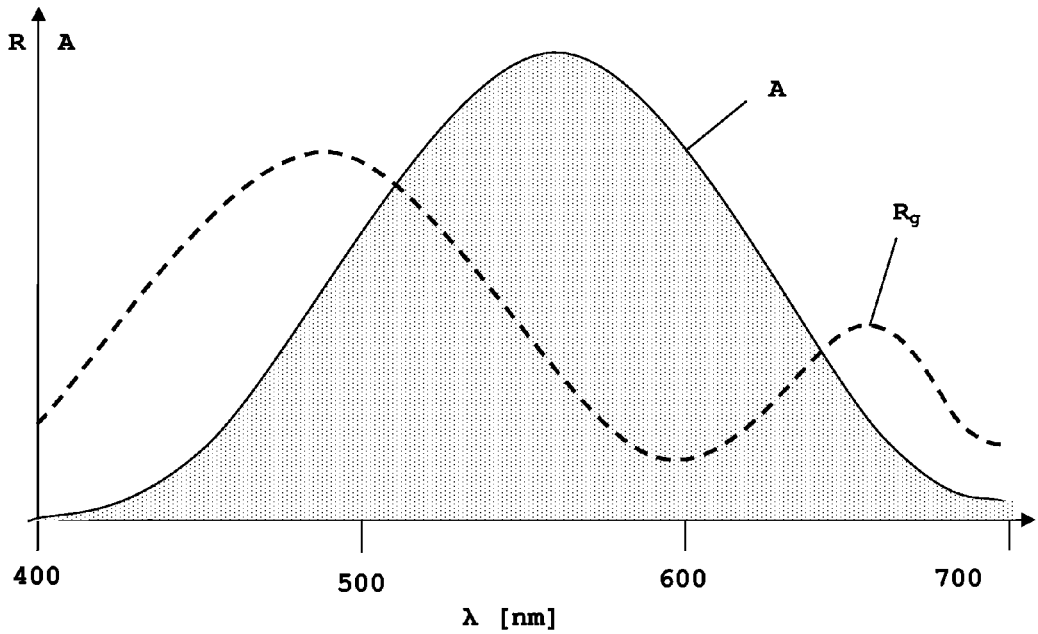

BLACK-TO-COLOR SHIFTING SECURITY ELEMENT

FIELD OF THE INVENTION

The present invention relates to security documents or articles. More specifically, it discloses a color shifting security element which appears black under orthogonal view, for use on security documents or articles, to protect them against counterfeit and illegal reproduction.

BACKGROUND OF THE INVENTION

Color shifting security elements have been used in numerous applications, e.g. as a security feature on banknotes, identity documents, documents of value, documents of rights, tax banderoles, security labels, branded goods and the like, to protect them against counterfeit and illegal reproduction. Color shifting security elements can be produced by applying a coating composition (e.g. an optically variable ink) containing an optically variable pigment (OVP), such as a flake pigment disclosed in e.g. U.S. Pat. No. 4,424,010; U.S. Pat. No. 5,084,351; U.S. Pat. No. 5,171,363; EP 227 423, U.S. Pat. No. 5,653,792; U.S. Pat. No. 5,279,657; U.S. Pat. No. 5,766,738; U.S. Pat. No. 5,571,624; U.S. Pat. No. 5,569,535; U.S. Pat. No. 5,383,995; U.S. Pat. No. 5,278,590; U.S. Pat. No. 5,059,245; U.S. Pat. No. 4,838,648; U.S. Pat. No. 5,214,530 onto an appropriate substrate surface. Printings realized with optically variable inks (OVI®) exhibit the property of changing color upon variation of the angle of observation.

Optically variable pigments are interference pigments which exhibit a substantial angle-dependent color variation, i.e. which exhibit clearly observable different colors under e.g. an orthogonal and a grazing view. This applies for pigments having a low refractive index interference layer (refractive index n smaller than 2.0). Pigments with a high refractive index interference layer (n larger than 2.0), such as $TiO_2$ coated mica pigments, do not exhibit a substantial angle-dependent color variation.

To increase the color gamut of optically variable inks, it can be of advantage, as disclosed in EP-B1-0 227 423, to add soluble dyes or insoluble pigments to the ink formulation, to modify the reflection characteristics of the optically variable pigment and/or to block out unwanted spectral domains in order to achieve predefined color properties. For example, a Cromophtal yellow pigment (from Ciba-Geigy) can be added to a gold-to-green optically variable ink, to block out the reflected blue spectral parts at 400 nm, therefore giving a brighter appearance to the golden orthogonal-view color of the gold-to-green OVI®.

At present, coatings shifting from a first color to a second color, as well as from a first color to black in going from orthogonal to grazing view, are used on currency for its authentication by the unaided eye. Black at grazing view is achieved by mixing the optically variable pigment with a conventional dye or pigment, which has a complementary color to that of the optically variable pigment at grazing view. U.S. Pat. No. 5,059,245 discloses an ink comprising optically variable flakes and a pigment, dispersed in the ink vehicle for blocking out undesired colors at angles of incidence higher than first and second angles of incidence.

Black printing is noteworthy important in currency design, as it allows for a good visibility of the printed features even under difficult light condition, as well as for the easy incorporation of certain types of security elements. For design reasons, there is thus a need for optically variable inks which have black as one of their appearances.

However, the said coating, which shifts from a first color at orthogonal view to black at grazing view, suffers from the drawback that the black at grazing view is difficult to see. Indeed, due to the physics of the system, the black in said coatings only appears in a very narrow range of observation angles (vide infra), and due to physiology and psychology of human vision, certain colors, such as claret, olive or violet, already appear per se almost black at grazing view.

SUMMARY OF THE INVENTION

It was the object of the present invention to provide a color-shifting security element which displays a more evident change between black and color, and which thus overcomes the drawbacks of the prior art.

It has been surprisingly found that, by providing the hereafter described security element, which shifts from a black appearance at orthogonal view to a color at grazing view, the above object is conveniently solved.

The security element according to the present invention is based on a combination of an optically variable pigment and a light-absorbing material which substantially blocks out the visible spectral components which are reflected by said optically variable pigment at orthogonal incidence, resulting in a black appearance of the security element in orthogonal view.

Said combination is herein to be understood in the functional sense of the cooperative optical effect produced by the conjunction of the light absorbing material and the optically variable pigment.

Substantially blocking out the visible spectral components reflected by the optically variable pigment at orthogonal incidence means that the result of the said combination shall have a lightness (L*) smaller than 50 units and a chroma (C*) smaller than 15 units, as measured and determined according to the CIELab 1976 color system.

Thus, the present invention discloses a security element for a banknote, a documents of value, right or identity, a ticket, a label, a branded good identifier, or a tax banderole, comprising the combination of a coating containing at least one optically variable pigment having a substantial viewing-angle dependent color variation, selected from the group consisting of the vacuum-deposited thin-film interference pigments, the interference-layer coated particles, and the cholesteric liquid crystal pigments, and at least one selective spectral absorbing material having spectral absorption properties such as to substantially block out the visible spectral components which are reflected by said optically variable pigment at orthogonal incidence, so that said security element exhibits a black appearance when viewed at orthogonal angle, and a colored appearance when viewed at grazing angle.

According to the present invention, said optically variable pigment is preferably a multilayer interference pigment comprising reflecting, dielectric and absorbing layers, and said selective spectral absorbing material is a compound or a mixture of compounds selected from the group consisting of the soluble organic dyes, the insoluble organic pigments, and the insoluble inorganic pigments.

The color shifting security element of the present invention, which starts from black at orthogonal view, is noteworthy much better defined (vide infra) and easier identified than those elements of the prior art which change to black at grazing view. Noteworthy, the shift from a black appearance to a color upon changing the viewing angle from orthogonal to oblique is easier perceived than the opposite case, because the human vision is quite sensitive to the unexpected appearance of a color at grazing view, even under difficult illumination conditions, whereas the change of a visual object to a dark or black appearance at grazing view is a rather common phenomenon.

An additional benefit of the security element of the present invention lies in the fact that a black face appearance is frequently part of security document designs, such that an existing design can be upgraded with the security element of the present invention without impacting significantly on the known orthogonal-view image of the document or the protected item in question. Such upgraded security elements may also be combined to form pairs of geometameric colors.

In the context of the present disclosure, orthogonal view or incidence means an angle of 90°±15° with respect to the plane of the substrate, and grazing view means an angle between 0° and 30° with respect to the plane of the substrate. Oblique view means a not-orthogonal view.

In the context of the present disclosure, a geometameric pair of colors is defined as two printed areas, juxtaposed or superposed, or printed not too far one from the other, which have a similar visual appearance (appearance being defined by CIELab hue, chroma and lightness) at orthogonal viewing angle and a significantly different appearance at a grazing angle of view.

In the context of the present invention, "selective spectral absorbing material" means a material which absorbs electromagnetic radiation only in a specific region of the visible spectrum.

In the context of the present disclosure, black shall be understood as having a lightness (L*) smaller than 50 units and a chroma (C*) smaller than 15 units in the CIELab 1976 color system (as characterised on a spectrophotometer under diffuse illumination, specular excluded, and 8° detection measuring conditions, as known in the art).

DETAILED DESCRIPTION OF THE INVENTION

The security element of the present invention is based on a combination of i) a reflecting optically variable pigment having a substantial viewing-angle dependent color variation, comprised in a coating, and ii) a selective spectral absorbing material. More particularly, said selective spectral absorbing material is chosen such as to substantially block out the visible spectral components reflected by said optically variable pigment at orthogonal incidence. The result is a black appearance of the security element at orthogonal view.

Optically variable pigments having a substantial viewing-angle dependent color variation are known in the art. Said optically variable pigment can be chosen from the group of vacuum-deposited thin-film interference pigments (e.g. according to U.S. Pat. No. 4,434,010, U.S. Pat. No. 4,879,140), interference-layer coated particles (e.g. according to DE 195 25 503, EP 0 338 428), and cholesteric liquid crystal pigments (e.g. according to DE 195 02 413).

In particular, said optically variable pigment can be chosen as a multilayer interference pigment comprising reflecting, dielectric and absorbing layers. Particularly preferred are the optically variable pigments which are disclosed in e.g. U.S. Pat. No. 4,424,010; U.S. Pat. No. 5,084,351; U.S. Pat. No. 4,838,648; U.S. Pat. No. 5,214,530; U.S. Pat. No. 5,281,480; U.S. Pat. No. 5,383,995; U.S. Pat. No. 5,569,535; or U.S. Pat. No. 5,571,624.

The selective spectral absorbing material is a compound or a mixture of compounds selected from the group consisting of the soluble organic dyes, the insoluble organic pigments, and the insoluble inorganic pigments. A dye is a colorant which is soluble (i.e. dissolved) in the application medium, whereas a pigment is a colorant which is insoluble (i.e. dispersed) in the application medium. Useful dyes and pigments are known to the skilled in the art of ink making and can be found in e.g. O. Lückert, *Pigment+Füllstoff Tabellen,* 5. Ed., Laatzen, 1994, which is incorporated by reference herein.

A suitable absorbing material, i.e. an absorbing dye or pigment or a suitable mixture, is selected according to the spectral reflection characteristics of the optically variable pigment. The absorbing material must have spectral absorption characteristics which comprise the spectral range of reflection of the optically variable pigment at least in the visible range of the spectrum, i.e. at least between 450 nm and 650 nm wavelength, if possible, between 400 nm and 700 nm. This means that, for each wavelength in this range, the absorbing material must have sufficient absorbance so as to compensate for the light intensity reflected by the optically variable pigment at that wavelength. Higher absorbance in parts of the spectrum may be present at will, as long as the "black-to-color" shift of the element is preserved. The only condition is that, at orthogonal view, the net reflected light intensity R[l] of the security element in the visible range of the spectrum fulfils the already stated condition of 'black', i.e. of having a CIELab lightness (L*) smaller than 50 units and a CIELab chroma (C*) smaller than 15 units.

The net reflected light intensity R[λ] of the disclosed security element, as a function of the wavelength λ, can noteworthy be described in the following terms:

$$R[\lambda]=I/I_0=a[\lambda]*r[\lambda]*a[\lambda]=a^2[\lambda]*r[\lambda]$$

wherein a[λ] is the absorbance of the absorbing material, i.e. the light attenuation due to the presence of the absorbing material upon single passage of the light through the absorber layer at the present concentration. The a[λ] term enters as a square because there are two passages of the light through the absorber involved, one upon incidence, and another one after reflectance.

r[λ] is the reflectance of the optically variable pigment, i.e. the part of incident light which is reflected by the optically variable pigment $I_0$ is the intensity of the incident light I is the intensity of the reflected light all is measured at the wavelength λ, according to methods known in the art.

Said selective spectral absorbing material can herein be embodied in the security element as one of the following, i) at least one absorbing dye or pigment or a mixture thereof comprised in the coating containing said reflecting optically variable pigment; ii) a second coating, applied over at least part of a first coating containing said reflecting optically variable pigment, said second coating comprising at least one absorbing dye or pigment or a mixture thereof; iii) a foil or decal, applied on top of at least part of a first coating containing said reflecting optically variable pigment, and said foil or decal comprising at least one absorbing dye or pigment, or a mixture thereof.

A further advantage of the security element according to the present invention is its better definition, i.e. that it presents a black appearance over quite a large range of viewing angles around the orthogonal to the plane of the element, which is not the case of the security elements of the prior art, which go to black at grazing view. It has been found that the color of optically variable interference pigments does not but slowly change with angle at about orthogonal view. It is thus possible to efficiently compensate for the pigment's reflected spectral components over said quite large range of viewing angles.

With reference to FIG. 1*a*, the wavelength of maximal reflection (λ), as a function of the incidence of angle (θ), of a thin-film interference pigment particle, is noteworthy given by formula [1].

$$\frac{2d}{m} * \sqrt{n_2^2 - \cos^2(\theta)} = \lambda \quad [1]$$

wherein:

d=physical thickness of the dielectric layer $n_2$=index of refraction of the dielectric layer m=1, 2, 3, . . . order of diffraction Formula [1] is obtained through the combination of Bragg's law $2n_2d \sin(\theta')=m\lambda$ with Snell's law of refraction $n_1*\cos(\theta)=n_2*\cos(\theta')$, with $n_1=1$.

Figure 1B:
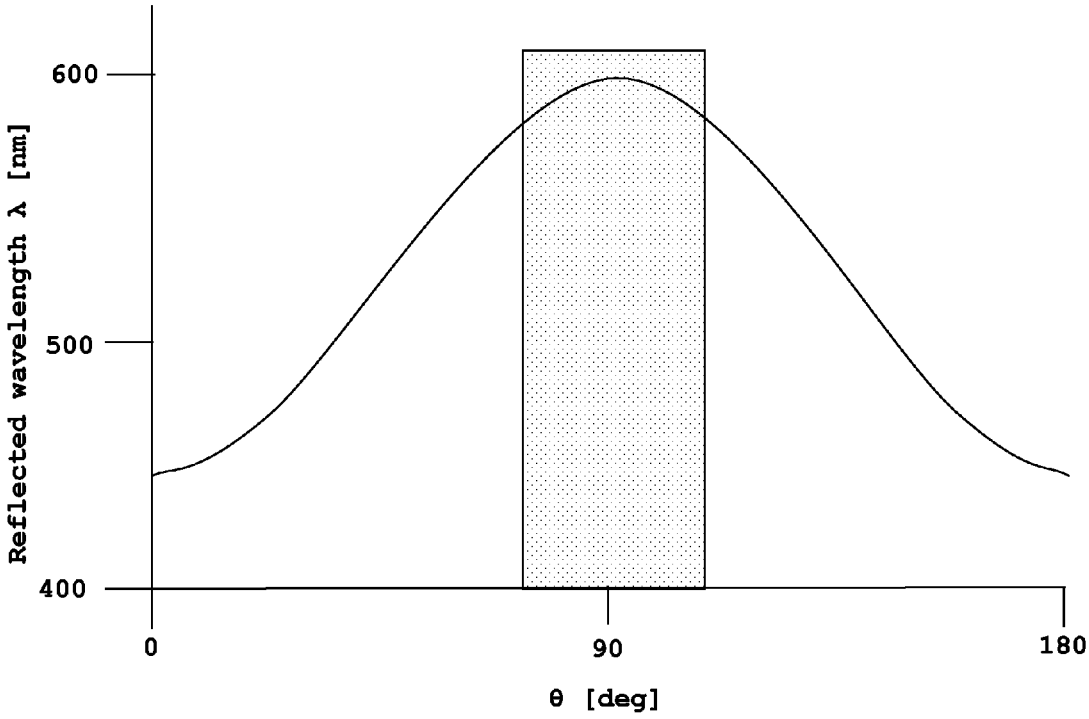

FIG. 1*b* represents the resulting viewing angle dependence of the wavelength of maximum reflection (m=1) for a chosen dielectric ($n_2$=1.5) of a chosen thickness (d=200 nm). With reference to FIG. 1*b*, it is easily seen that the wavelength of maximal reflection is almost constant around orthogonal incidence (90°±15°: Δλ<10 nm) but decreases rapidly at lower incidence (75° to 30°: Δλ>100 nm).

The present invention takes now advantage of the above identified fact that the optically variable pigment's color shift remains small within quite a large range of viewing angles around orthogonal incidence. It is thus possible to selectively absorb said pigment's reflected spectral components with the help of conveniently chosen absorbing materials, so as to produce a black appearance over said quite large range of viewing angles.

Said production of a black appearance at orthogonal view can in practice be achieved in one of the following ways: i) by the addition of a particular dye, pigment, or a mixture thereof, to a color shifting coating composition, such as an optically variable ink (OVI®) comprising said optically variable pigment; ii) by overprinting/coating a color shifting coating with a second coating composition comprising a particular dye, pigment or a mixture thereof; or iii) by applying over said color shifting coating a foil or decal, comprising a particular dye, pigment or a mixture thereof; all to produce a black appearance through the selective absorption of the reflected visible spectral components of the incident light by the said absorbing material at orthogonal angle of view.

The selective spectral absorbing material comprising said dye, pigment, or a mixture thereof, is chosen in such a way, that its spectral absorbing area substantially coincides with or comprises, the components of the visible spectrum which are reflected by said optically variable pigment at orthogonal incidence, such that the perceived appearance is black when the security element is viewed at orthogonal angle.

According to the invention, the visible spectral components reflected by the optically variable pigment at orthogonal incidence are thus substantially blocked out by the absorbing material. Under oblique incidence, such as 45° to 70°, however, the optically variable pigment's reflection characteristics shift to shorter wavelengths (equation 1), and said absorbing material does no longer absorb all spectral components reflected by the optically variable pigment. The security element therefore changes its appearance from black to colored upon changing the viewing angle from orthogonal to grazing.

The security element of the present invention can e.g. be realized by combining i) a green-to-magenta optically variable coating, which has, at orthogonal incidence, a peak of maximum reflectance around a wavelength of 550 nm, with ii) an appropriate concentration of a magenta dye, which has a peak of maximal absorbance around a wavelength of 550 nm. The spectral absorption characteristics of the magenta dye should furthermore be at least as large in wavelength as the spectral reflection characteristics of the optically variable pigment, so as to result in a black appearance at orthogonal view. At oblique view, the security element appears as magenta-colored.

In another embodiment, the same green-to-magenta coating is combined with an appropriate concentration of a red dye, which has an absorption edge at around 600 nm wavelength, i.e. which absorbs the visible radiation with wavelength below 600 nm. Again, the security element appears black at orthogonal view, but changes to red at oblique view.

In still another embodiment, the same green-to-magenta coating is combined with an appropriate concentration of a blue dye, which has an absorption edge at around 500 nm wavelength, i.e. which absorbs the visible radiation with wavelength above 500 nm. The security element, which appears black at orthogonal view, changes now to blue at oblique view.

It is evident from the present disclosure that the skilled man may realize many further combinations of optically variable coatings with absorbing dyes, so that the resulting security element appears black at orthogonal view and colored at oblique view. Noteworthy, optically variable pigments having more complicated spectral reflectance characteristics than a simple reflection maximum, e.g. such which have two or more of such maxima in the visible range, or even such which do not have a smooth, but rather an accentuated reflection characteristics, can be used as well, in conjunction with absorbing materials having suitable absorption characteristics.

The respective amount of optically variable pigment and absorbing material are chosen according to the desired optical effect, provided however that the color shift underlying the present invention, i.e. from black at orthogonal view to colored at grazing view, remains observable. Typical amounts to be used are in the range of: 5-50 wt.-%, preferably 10-25 wt.-% of said optically variable pigment; and 0.1-20 wt.-%, preferably 0.2-10 wt.-% of said absorbing material.

To further increase the counterfeit resistance of the herein disclosed security element, the color-shifting coating and/or said second coating and/or said foil or decal can be made to exhibit additional properties, such as luminescence, magnetism, infrared absorption, etc. This can be achieved by adding at least one material selected from the group consisting of the luminescent materials, the magnetic materials, and the infrared absorbing materials, to at least one portion of said security element; i.e. either to said color-shifting coating and/or to said second coating and/or to said foil or decal.

Color shifting security elements according to the present invention, which shift from black to a defined color, can be combined together, for instance printed in juxtaposition, to create pairs of geometameric colors, having a substantially identical hue (black) under orthogonal viewing angle, and two clearly different colors at grazing view.

Another way to use the color-shifting security element of the present invention is to apply it close to a not color-shifting element having a similar black or dark appearance at orthogonal view, such that the perceived color shift appears enhanced at grazing view.

Furthermore, the security element according to the invention can be combined with, or applied in the form of indicia of any type. Said indicia can hereby be produced through printing, laser marking, magnetic orientation, etc.

Further disclosed is a method for producing the security element of the present invention on a substrate, comprising the step of providing a substrate with a combination of a coating applied on said substrate, said coating containing at least one optically variable pigment having a substantial viewing-angle dependent color variation, selected from the group consisting of the vacuum-deposited thin-film interference pigments, the interference-layer coated particles, and the cholesteric liquid crystal pigments, and at least one selective spectral absorbing material having spectral absorption properties such as to substantially block out the visible spectral components reflected by said optically variable pigment at orthogonal incidence, wherein said selective spectral absorbing material is present either in said coating containing the optically variable pigment, or in a coating composition applied on top of at least part of the coating containing the optically variable pigment, or in a foil or decal applied on top of at least part of the coating containing the optically variable pigment the combination being such that said security element exhibits a black appearance when viewed at orthogonal angle, and a colored appearance when viewed at grazing angle.

The coatings of the invention can be applied using the printing methods known in the art, such as engraved steel plate (intaglio), silkscreen, gravure, offset, letterpress- or flexographic printing. For applying a foil or decal the generally known methods of heat- or cold-stamping can be used.

Further disclosed is a security document, comprising at least one security element according to the present invention exhibiting a black appearance at orthogonal view and a color at oblique view. Said security document is preferably selected from the group of documents consisting of banknotes, documents of value, right or identity, labels, branded good identifiers, and tax banderoles.

A second security element according to the invention may be applied on a same document in juxtaposition to said security element, wherein said two security elements form a geometameric color pair exhibiting a black appearance at orthogonal angle of view and two different colors at grazing view.

The document may further comprise in the vicinity of said security element, a not color-shifting element having a similar black or dark appearance at orthogonal view.

The invention is now further explained with the help of the figures and of exemplary embodiments.

FIG. 1*a* schematically depicts the reflection of a beam of light (B) incident at angle$\theta$ on the surface of a thin-layer interference pigment (P). A first part of the beam (B1) is reflected at a first surface (1) and interferes with a second part of the beam (B2) which is reflected at a second surface/interface (2), after passing through a dielectric layer (3) of physical thickness d and refraction index $n_2$. The refraction index ($n_1$) of the outer medium is assumed to be 1.0 (air).

FIG. 1*b* graphically depicts calculated wavelengths of maximum reflection ($\lambda$) as a function of the incidence angle$\theta$, according to equation [1], assuming $n_2$=1.5; d=200 nm and m=1. The variation of $\lambda$ is minimal around orthogonal incidence ($\theta$=90°±15°; $\Delta\lambda$<10 nm) and maximal at oblique incidence (75°>$\theta$>30°; $\Delta\lambda$>100 nm).

In FIG. 2*a*, curve $R_0$ represents the reflected spectral components of the optically variable pigment (OVP) at orthogonal view. The absorption characteristics A of the absorbing material substantially overlap the reflection characteristics of the OVP in the visible part of the spectrum (400 nm-700 nm). The visual appearance of the element is black.

In FIG. 2*b*, curve $R_g$ represents the reflected spectral components of the OVP at grazing view. Substantial parts of the reflection characteristics $R_g$ fall outside the absorption characteristics A of the absorbing material in the visible part of the spectrum. The element appears colored.

Figure 3:
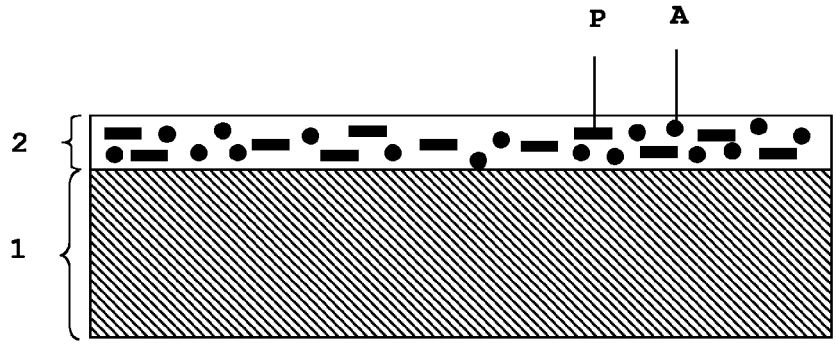

FIG. 3 schematically depicts a security element (2) according to the invention, which is applied on a surface of a substrate (1) via a single printing step. The optically variable pigment (P) and the absorbing material (A) are both comprised in the same coating composition.

Figure 4:
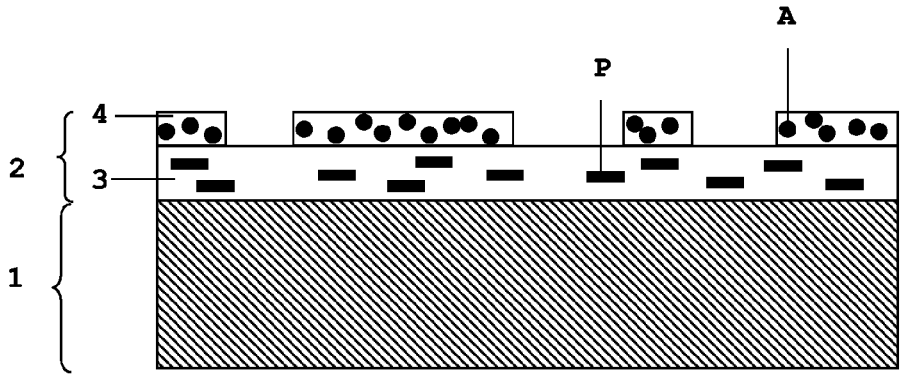

FIG. 4 schematically depicts a security element (2) according to the invention, wherein a coating composition (3) comprising at least one optically variable pigment (P) is applied onto a surface of a substrate (1), and coated at least in part with a second coating composition (4) comprising absorbing material (A).

Figure 5:
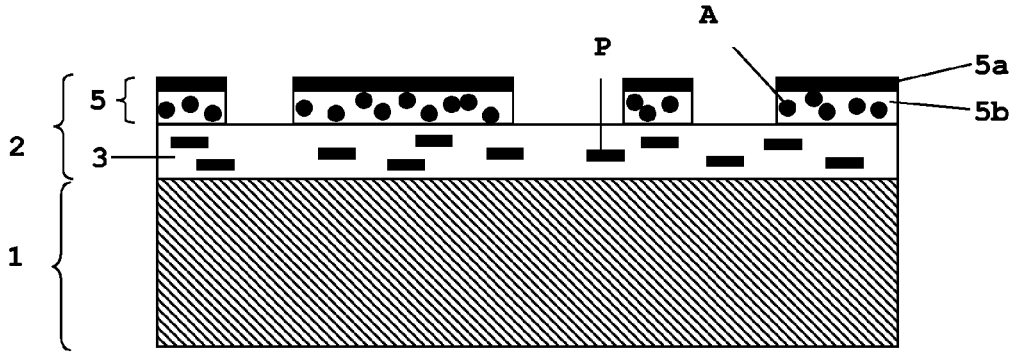

FIG. 5 schematically depicts a security element (2) according to the invention, wherein a coating composition (3) comprising at least one optically variable pigment (P) is applied onto a surface of a substrate (1), and coated at least in part with a foil or decal (5) comprising an absorbing material (A).

Figure 6A:
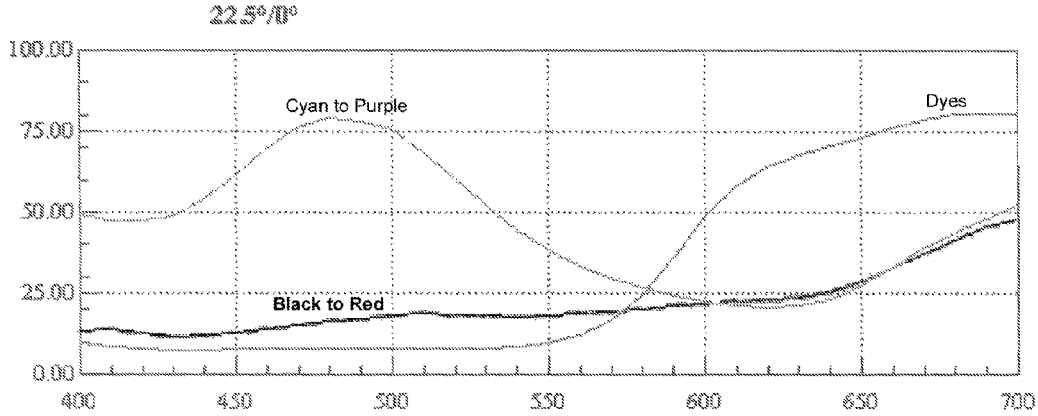

FIG. 6*a* shows the reflection spectra recorded at an illumination angle of 22.50 with respect to the normal (orthogonal) of the surface versus a detection angle of 0°, i.e. perpendicular to the surface. The bold line represents the reflection spectrum of the combination of the color shifting pigment and the selective spectral absorbing material (in this case 7% of a dye mixture comprising C.I.: Solvent Red 92 and Solvent Yellow 79). The said reflection spectrum is a flat minimum in the whole visible spectrum from 400 to 650 nm, and the security element appears black.

Figure 6B:
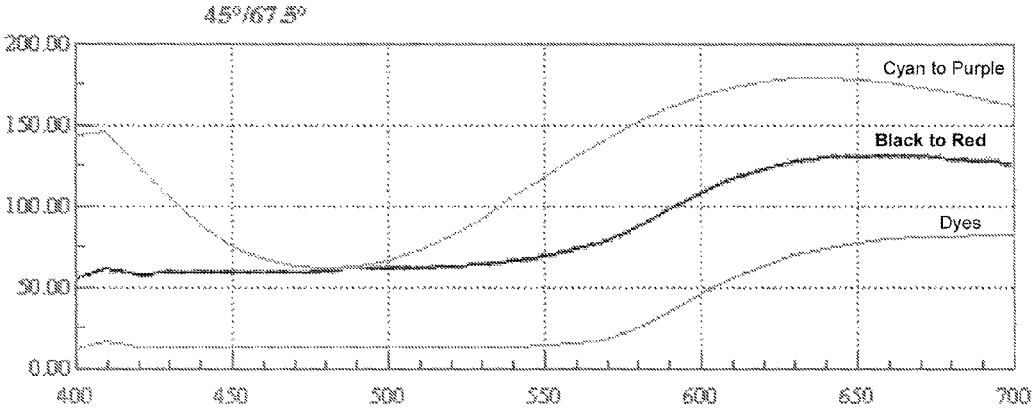

FIG. 6*b* shows the reflection spectra recorded at an illumination angle of 45° versus a detection angle of 67.5°, both with respect to the normal (orthogonal) of the surface. The bold line represents the reflection spectrum of the combination of the color shifting pigment and said dye mixture. A reflection maximum appears at 640 nm i.e. the security element appears red.

The overall visual impression of the security element is thus a shift from black at orthogonal view to a red color at oblique view.

Referring to FIG. 3, in a first embodiment of the security element (2), an absorbing material (A), such as a dye or a pigment or a mixture thereof, is mixed with a color shifting coating composition, and the resulting composition is applied onto the surface of a substrate (1). The absorbing material (A) is herein chosen so as to absorb substantially all of the visible light which is reflected by the color shifting pigment (P) at orthogonal incidence, thus the security element (2) appears black when viewed at orthogonal angle.

Referring to FIG. 4, in a second embodiment of the security element (2), a first, color shifting, coating composition (3) is applied to the surface of a substrate (1), and said color shifting coating composition (3) is subsequently coated at least in part with a second coating composition (4) comprising an absorbing material (A) such as a dye, pigment or a mixture thereof. Said absorbing material (A) is herein chosen as to absorb substantially all of the visible light which is reflected by the color shifting pigment (P) at orthogonal incidence, thus the security element (2) appears black when viewed at orthogonal angle.

Referring to FIG. 5, in a third embodiment of the security element (2), a first, color shifting, coating composition (3) is applied to a substrate (1), wherein said first color shifting coating composition (3) is subsequently covered at least in part with a foil or decal (5) comprising an absorbing material (A) such as a dye, pigment or a mixture thereof. Said absorbing material is hereby comprised either in the body (5*a*) of said foil or decal, or in a coating (glue) layer (5*b*) applied to said foil or decal, or in both. Said coating (glue) serves to affix said foil or decal to said substrate carrying said optically variable pigment. Said absorbing material (A) is herein chosen as to absorb substantially all of the visible light which is reflected by the color shifting pigment (P) at orthogonal incidence, thus the security element (2) appears black when viewed at orthogonal angle.

The security element of the first embodiment (example 1) with reference to FIG. 3, is produced by screen printing. The optically variable ink comprises optically variable pigment in the range of 5 to 50 percent by weight, preferably of 10 to 25 percent by weight. The optically variable ink is mixed with an absorbing material such as a dye or pigment or a mixture thereof, in the range of 0.1 to 20 percent by weight, preferably of 0.2 to 10 percent by weight.

The security element of an alternative form of the first embodiment (examples 2, 3) with reference to FIG. 3, is produced by gravure printing. The optically variable ink comprises optically variable pigment in the range of 5 to 50 percent by weight, preferably of 25 percent of weight. The optically variable ink is mixed with an absorbing material such as a dye or pigment or a mixture thereof in the range of 0.1 to 20 percent by weight, preferably of 0.2 to 10 percent by weight.

EXAMPLE 1

Silkscreen Printing

Solvent based silkscreen ink composition providing for a security element with a color shift form black to red.

| | |
|---|---|
| Diethyl ketone | 25.4% |
| Ethyl diglycol | 32% |
| Solution Vinyl VMCA (Union Carbide) | 24% |
| BYK-053 (BYK) | 1% |
| Chromaflair ® Green to Purple 190L (Flex Products Inc.) | 16% |
| Pigment mixture of absorbing material* | 1.6% |

*comprising C.I.: Pigment Red 184; Pigment Black 7

The viscosity was adjusted using a blend of diethyl ketone and ethyl diglycol, so as to reach a value of 500 to 1000 mPa*s at 25° C. The ink was applied with a coating bar, allowing for a theoretical wet film deposit of 24 μm onto coated paper, and dried with hot air.

EXAMPLE 2

Gravure Printing

Gravure printing ink composition providing for a security element with a color shift form black to red.

| | |
|---|---|
| Ethanol | 24% |
| Ethyl acetate | 28% |
| Dicyclohexylphtalate (Unimoll 66, Bayer) | 3.5% |
| Fumaric acid modified resin (Rokramar 7200, Robert Kraemer) | 3.5% |
| Polyvinylbutyral resin (Pioloform BN18, Wacker-Chemie) | 9% |
| Chromaflair ® Cyan to Purple 230L (Flex Products Inc.) | 25% |
| Dye mixture of absorbing material* | 7% |

*comprising C.I.: Solvent Red 92, Solvent Yellow 79

The viscosity was adjusted using a blend of ethanol and ethyl acetate, so as to reach a value of 20 to 40 s when measured with a DIN 4 cup at 25° C. The ink was applied with a coating bar, allowing for a theoretical wet film deposit of 24 μm onto coated paper, and dried with hot air.

EXAMPLE 3

Gravure Printing

Gravure printing ink composition providing for a security element with a color shift form black to green.

| | |
|---|---|
| Ethanol | 23.7% |
| Ethyl acetate | 27.65% |
| Dicyclohexylphtalate (Unimoll 66, Bayer) | 3.5% |
| Fumaric acid modified resin (Rokramar 7200, Robert Kraemer) | 3.5% |
| Polyvinylbutyral resin (Pioloform BN18, Wacker-Chemie) | 9% |
| Varicrom ® Magic Red L4420 (BASF) | 30% |
| Dye mixture of absorbing material* | 2.65% |

*comprising C.I.: Solvent Yellow 174; Savinyl Green 2GLS 01P (Clariant)

The viscosity was adjusted using a blend of ethanol and ethyl acetate, so as to reach a value of 20 to 40 s when measured with a DIN 4 cup at 25° C. The ink was applied with a coating bar, allowing for a theoretical wet film deposit of 24 μm onto coated paper, and dried with hot air.

EXAMPLE 4

Intaglio Printing—Engraved Steelplate Printing

Intaglio printing ink composition providing for a security element with a color shift form black to green.

| | |
|---|---|
| Addition product of tung oil and maleic acid modified phenolic resin in a high boiling mineral oil (PKWF ® 28/31, Haltermann) | 32% |
| Long oil alkyd resin | 7% |
| Alkylphenolic resin modified with raw tung oil, in ink solvent 27/29 (Shell Industrial Chemicals) | 15% |
| Polyethylene wax | 1.5% |
| Calcium carbonate | 8.3% |
| OVP ® Magenta to Green (Flex Products Inc.) | 25% |
| Cobalt octoate (11% metal) | 0.1% |
| Manganese octoate (10% metal) | 0.1% |
| Ink solvent 27/29 (Shell Industrial Chemicals) | 6% |
| Dye mixture of absorbing material* | 5% |

*comprising C.I.: Solvent Yellow 174; Savinyl Green 2GLS 01P

The viscosity was adjusted using ink solvent 27/29 (Shell), so as to reach a value of 6.5 to 9.5 Pa*s at 40° C. The ink was applied with an Ormag laboratory proofing press onto security paper, and dried by oxypolymerisation at ambient temperature (3 days).

EXAMPLE 5

Gravure Printing, Second Ink Overprinted on Top of the First

Gravure printing ink compositions providing for a security element with a color shift form black to gold, wherein the second ink composition is overprinted onto the first.

| First Ink Composition | |
|---|---|
| Ethanol | 26% |
| Ethyl acetate | 31% |
| Dicyclohexylphtalate (Unimoll 66, supplied by Bayer) | 4% |
| Fumaric acid modified resin (Rokramar 7200, Robert Kraemer) | 4% |
| Polyvinylbutyral resin (Pioloform BN18, Wacker-Chemie) | 10% |
| Securshift ® Violet to Bronze (Flex Products Inc.) | 25% |

| Second Ink Composition | |
|---|---|
| Ethanol | 34.2% |
| Ethyl acetate | 40.7% |
| Dicyclohexylphtalate (Unimoll 66, Bayer) | 5.2% |
| Fumaric acid modified resin (Rokramar 7200, Robert Kraemer) | 5.2% |
| Polyvinylbutyral resin (Pioloform BN18, Wacker-Chemie) | 13% |
| Dye mixture of absorbing material* | 1.7% |

*comprising C.I.: Solvent Yellow 79; Savinyl Green 2GLS 01P

The viscosities were adjusted using a blend of ethanol and ethyl acetate, so as to reach a value of 20 to 40 s when measured with a DIN 4 cup at 25° C. The inks were successively applied with a coating bar, allowing for a theoretical wet film deposit of each time 24 μm onto coated paper, and dried each time with hot air.

The invention claimed is:

1. Security element for a banknote, a document of value, right or identity, a ticket, a label, a branded good identifier, or a tax banderole, comprising i) a coating containing at least one optically variable pigment having a substantial viewing-angle dependent color variation, selected from the group consisting of vacuum-deposited thin-film interference pigments, interference-layer coated particles, and cholesteric liquid crystal pigments; and ii) at least one selective spectral absorbing material embodied as a compound or a mixture of compounds selected form the group consisting of soluble organic dyes, insoluble organic pigments, and insoluble inorganic pigments; wherein said selective spectral absorbing material has spectral absorption properties such that it substantially blocks out the visible spectral components reflected by said optically variable pigment at orthogonal incidence, and does not absorb all spectral components reflected by said optically variable pigment under oblique incidence, the security element thereby exhibiting a black appearance when viewed at orthogonal angle, and a colored appearance when viewed at grazing angle.

2. Security element according to claim 1, wherein said optically variable pigment is a multilayer interference pigment comprising reflecting, dielectric and absorbing layers.

3. Security element according to claim 1, wherein the selective spectral absorbing material is in the coating containing the optically variable pigment.

4. Security element according to claim 1, wherein the selective spectral absorbing material is in a coating composition applied on top of at least part of the coating containing the optically variable pigment.

5. Security element according to claim 1, wherein the selective spectral absorbing material is provided in a foil or decal applied on top of at least part of the coating containing the optically variable pigment.

6. Security element according to claim 1, additionally comprising at least one material selected from the group consisting of luminescent materials, magnetic materials, and infrared absorbing materials.

7. Security element according to claim 1, further comprising indicia.

8. Security document, comprising at least a first security element according to claim 1.

9. Security document according to claim 8, wherein said security document is selected from the group of documents consisting of banknotes, documents of value, right, or identity, labels, branded good identifiers, and tax banderoles.

10. Security document according to claim 8, further comprising a second security element according to claim 1 in juxtaposition to said first security element, wherein said two security elements form a geometameric color pair exhibiting a black appearance at orthogonal view and two different colors at grazing view.

11. Security document according to claim 8, further comprising, in the vicinity of said first security element, a non-color-shifting element having a similar black or dark appearance at orthogonal view.

12. Method of use of a security element according to claim 1, as a protection against counterfeit and illegal reproduction, on a banknote, a document of value, right, or identity, a label, a branded good identifier, or a tax banderole, said method comprising the step of applying said security element on said banknote, a document of value, right, or identity, a label, a branded good identifier, or a tax banderole.

* * * * *